US006513356B1

(12) United States Patent
Yang

(10) Patent No.: US 6,513,356 B1
(45) Date of Patent: Feb. 4, 2003

(54) DUAL MECHANISM LOCK

(76) Inventor: Ping-Jan Yang, P.O. Box 26-757, Taipei (TW), 106

( * ) Notice: Subject to any disclaimer, the term of this patent is extended or adjusted under 35 U.S.C. 154(b) by 0 days.

(21) Appl. No.: 10/012,446

(22) Filed: Nov. 9, 2001

(51) Int. Cl.[7] ..... E05B 13/10
(52) U.S. Cl. ..... 70/213; 70/219; 70/284; 70/285; 70/312
(58) Field of Search ..... 70/284, 285, 312, 70/213, 219, DIG. 71

(56) References Cited

U.S. PATENT DOCUMENTS 4,249,469 A * 2/1981 Craske ..... 109/59 R
4,499,745 A * 2/1985 Ricouard et al. ..... 70/285
4,557,122 A * 12/1985 Hwang ..... 70/312
4,671,088 A * 6/1987 Jeang ..... 70/312
4,770,013 A * 9/1988 Nakai ..... 70/285
4,885,923 A * 12/1989 Nakai
5,020,346 A * 6/1991 Eisermann ..... 70/285 X
5,345,798 A * 9/1994 Nakai ..... 70/284
5,485,734 A * 1/1996 Yang ..... 70/285
5,622,067 A * 4/1997 Waitz ..... 70/276
5,906,124 A * 5/1999 Su

FOREIGN PATENT DOCUMENTS

DE 302222 * 12/1917 ..... 70/284
DE 327600 * 10/1920 ..... 70/284

* cited by examiner

*Primary Examiner*—Lloyd A. Gall
(74) *Attorney, Agent, or Firm*—Rosenberg, Klein & Lee

(57) ABSTRACT

A dual mechanism lock; a combination lock structure is embedded into a external cylinder by a flexibly moving fixing plate; a combination wheel mechanism comprising a plurality of combination wheels and a latching wheel; the latching wheel can be embedded into the fixing plate; the other end of the fixing plate is coupled to an elastic member at the top portion in the lock body; the lock body is coupled to an external cylinder by the coupling base; an internal cylinder is sheathed into the external cylinder; the internal cylinder includes a lock core, such that the outer end of the external cylinder is a knob; a lock tongue is disposed at the inner end of the external cylinder; the key or the combination lock can produce coupling and detachment for the external cylinder through the lock core of the internal cylinder.

2 Claims, 6 Drawing Sheets

DUAL MECHANISM LOCK

BACKGROUND OF THE INVENTION

1. Field of the Invention

The present invention relates to a dual mechanism lock, more particularly to a lock structure that simultaneously comprising two mechanisms: the combination lock mechanism and the key lock mechanism.

2. Description of the Prior Art

In FIG. 1, a prior-art dual mechanism lock structure comprises a lock body 1*a*, and the lock body 1*a* further comprises a casing 11*a* and a bottom cover 12*a*, and the bottom cover 12*a* having a combination lock structure 2*a*, wherein the combination lock structure 2*a* is brought into action by a fixing plate 3*a*, and can produce coupling and detachment movements by working together with a knob 4*a* and a tongue 5*a*, which can give a single locking function. If the user forgets the numbers, then the lock cannot be unlocked, and it would be nice to have a key to open the lock. In view of the shortcomings of the prior art mentioned above, which are the subjects of improvements for a long time, hence the inventor of the present invention based on years of experience accumulated from the engagement in the related industry conducted extensive research to provide a more practical lock, resolve the foregoing shortcomings, and invented the present invention.

SUMMARY OF THE INVENTION

Therefore, the primary objective of the present invention is to provide a dual mechanism lock comprising a lock body, which simultaneously has two lock mechanisms: a combination lock mechanism and a key lock mechanism. The user just needs a set of numbers to unlock the combination lock or a key to unlock the key lock, and thus gives a more convenient way for the application. The present invention is characterized in that the combination lock mechanism works together with the fixing plate and produces an indirect control to the lock tongue, and will not interfere the key lock mechanism by directly controlling the lock tongue.

To attain the foregoing purpose, the structure of the present invention comprises a lock body in which a combination lock structure, an internal cylinder and an external cylinder of a key lock are disposed; the combination lock structure is embedded into a fixing groove on the external cylinder at a lateral side of a fixing plate on the combination lock structure; the combination wheel mechanism comprising a plurality of combination wheels, and each combination wheel further comprising a numbered wheel and a latching wheel, and each numbered wheel is pivotally coupled to the lock body; a spring is disposed at the axle bush; each latching wheel can be embedded into the guiding groove of the fixing plate; the other end of the fixing plate is coupled to an elastic member at the top portion in the lock body; the lock body is coupled to an external cylinder by the coupling base; an internal cylinder is sheathed into the external cylinder; the internal cylinder includes a lock core, such that the outer end of the external cylinder is a knob; a keyhole is disposed at an end surface of the knob; a lock tongue is disposed at the inner end of the external cylinder; the key can produce a coupling and detachment movement for the external cylinder through the lock core of the internal cylinder, and also can release the fixing plate from the latch by rotating the knob on the external cylinder with the correct numbers for the numbered wheel of the combination lock.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

To make it easier for our examiner to understand the objective of the invention, structure, innovative features, and performance, we use a preferred embodiment together with the attached drawings for the detailed description of the invention.

Figure 1:
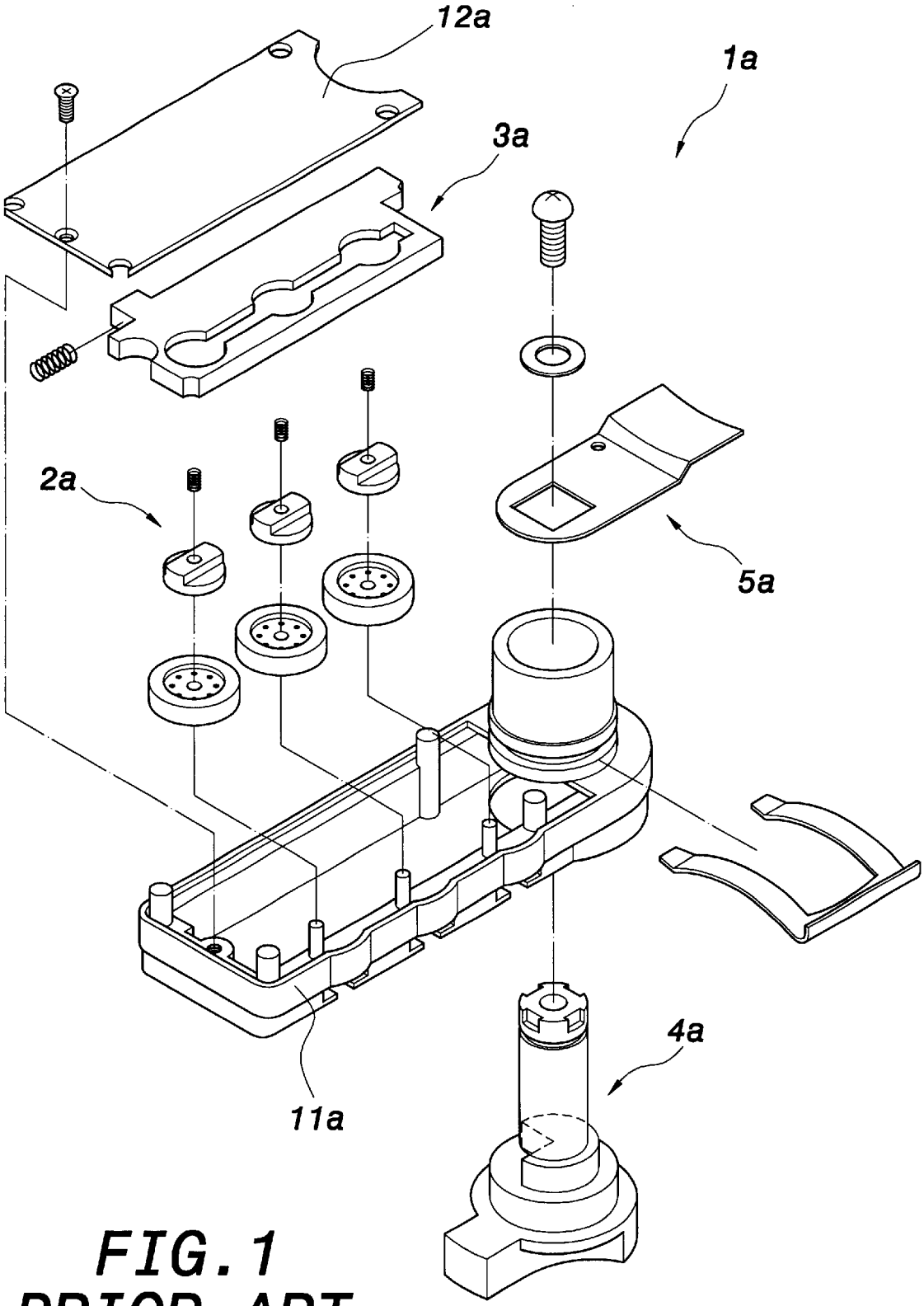
FIG. 1 PRIOR ART
FIG. 1 is a diagram of the prior-art structure.
Figure 2:
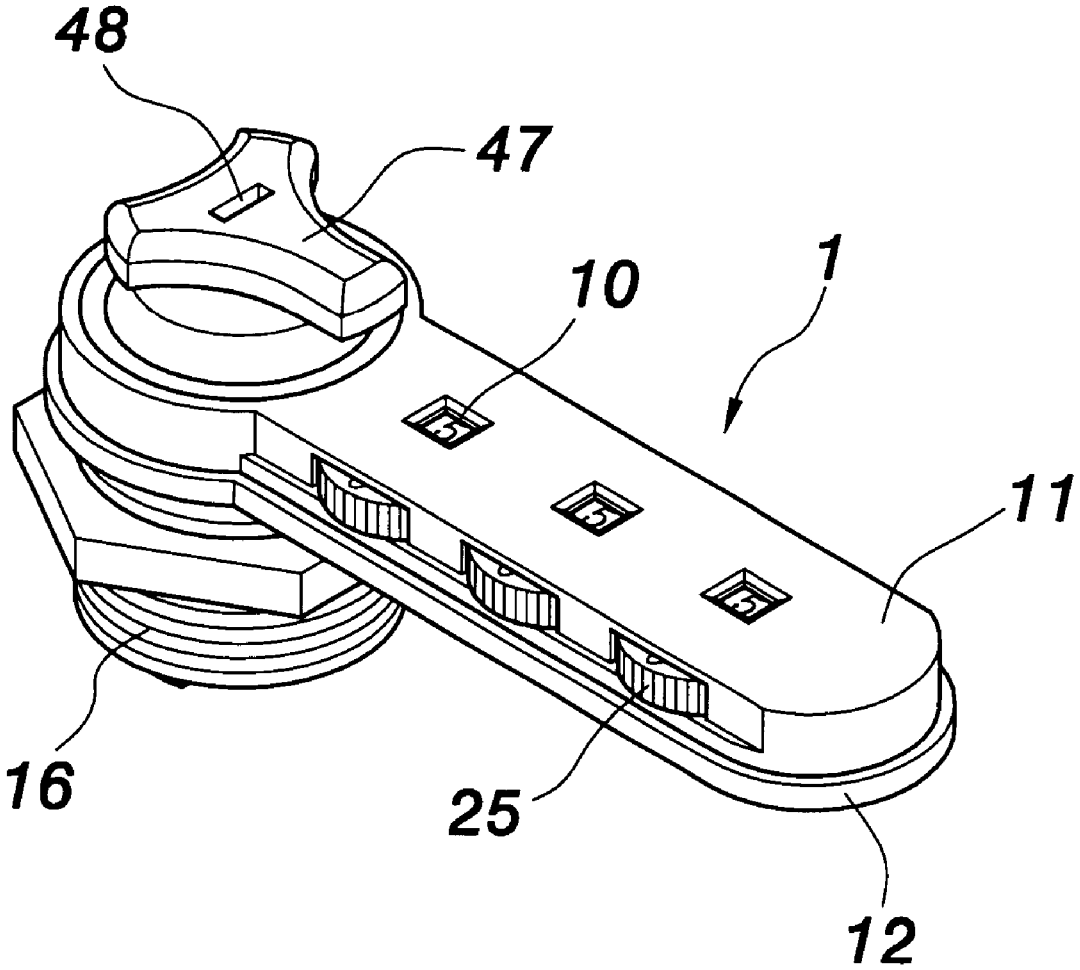
FIG. 2 is a diagram of the present invention.
Figure 3:
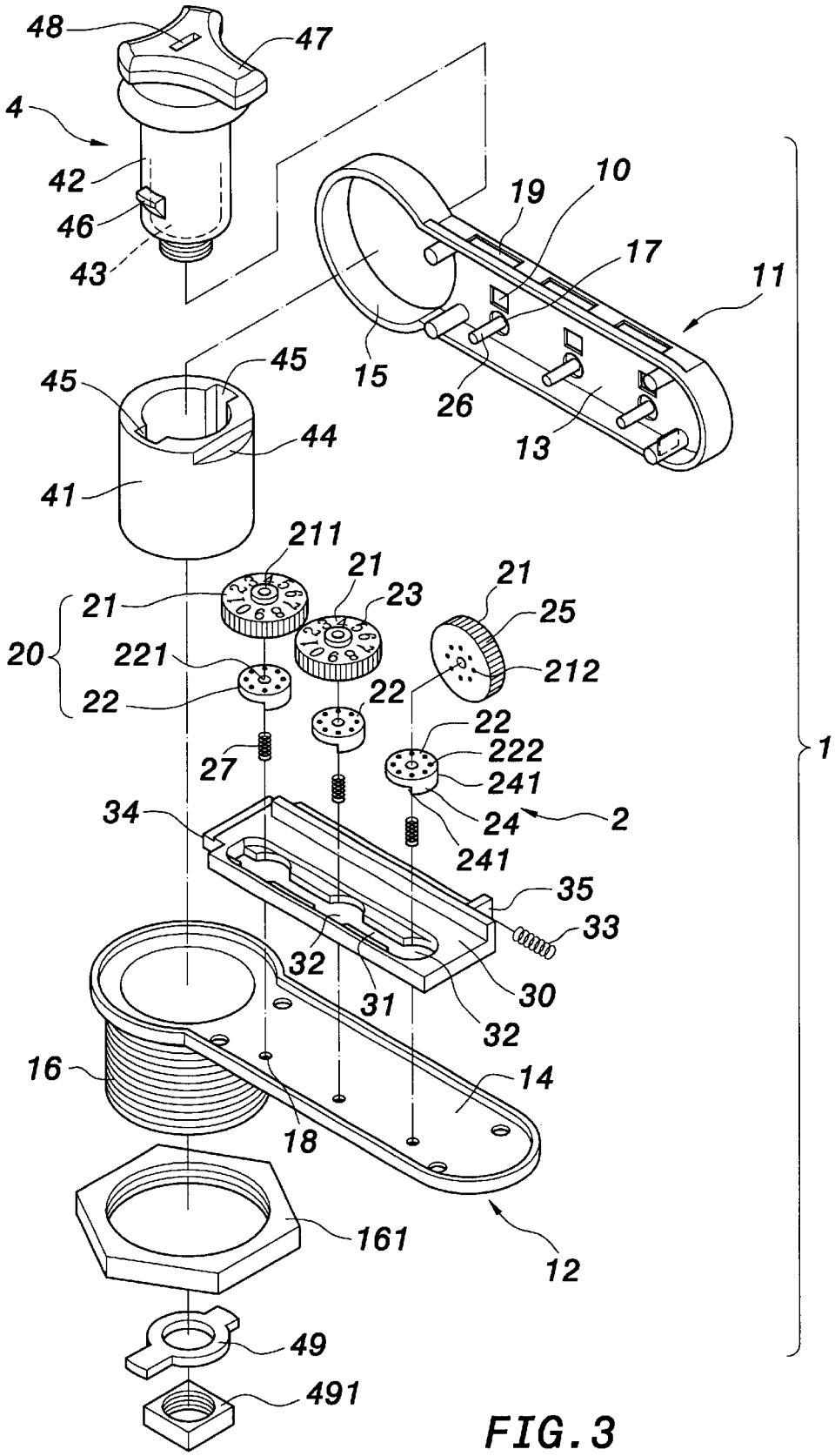
FIG. 3 shows the disassembled parts of the dual mechanism lock structure of the present invention.

Please refer to FIG. 2 to FIG. 3. The dual mechanism lock of the present invention comprises a lock body 1, and the lock body 1 is composed of an upper casing 11 and a lower casing 12; an upper accommodating space 13 is disposed in the upper casing 11, and an upper pivotal base 15 is on the other side; a lower accommodating space 14 is disposed in the lower casing 12, and a lower pivotal base 16 is on the other side, such that the upper casing 11 is coupled securely to the lower casing 12; a plurality of upper groove holes 17 are disposed at the inner surface of the upper casing 11, and a plurality of lower groove holes 18 are also disposed at the inner surface of the lower casing; a plurality of side holes 19 is disposed on the side surface of the upper casing 11; a plurality of through holes 10 are disposed at the top surface, and the lock body 1 has a combination lock mechanism 2 and a key lock mechanism 4.

The combination lock mechanism 2 comprises a plurality of combination wheels 20 and a fixing plate 30; each combination wheel 20 has a numbered wheel 21 and a latching wheel 22; a plurality of labeled numbers 23 are equidistantly disposed on the outer surface of the numbered wheel 21 and it allows only one labeled number 21 to be shown in the corresponding through hole 10; a plurality of protruded points 212 are disposed on the inner surface of the numbered wheel 21, and veins 25 are disposed on the lateral side such that part of the veins 25 is exposed through the side hole 19 of the upper casing 11, and the user can rotate the numbered wheel 21 through the side hole 19, and the number wheel 21 has a central hole 211.

A plurality of concave holes 222 are disposed on the outer surface of the latching wheel 22, and a unidirectional fixed-point protruded portion 24 is disposed on the inner surface of the latching wheel 22, and the latching wheel 22 has a central hole 221; each of the numbered wheels 20 has an axle 26 passing through the central hole 211 of the numbered wheel 21, and the central hole 211 of the latching wheel 22, and then both ends of the axle 26 are coupled to the corresponding upper groove holes 17 and the lower groove holes 18 in the lock body 1 respectively. The upper groove hole 17 can be omitted and the axle 26 could be integrally coupled to the upper casing 11.

Figure 3A:
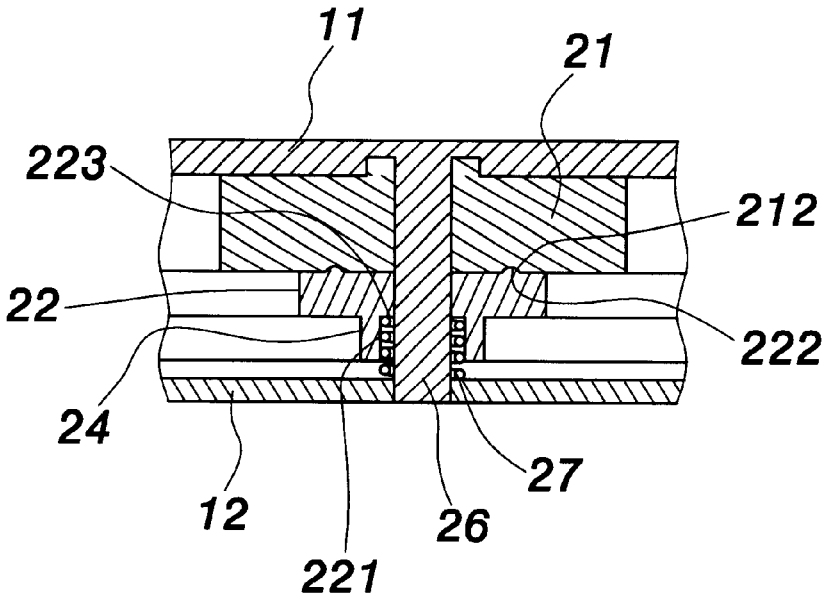
FIG. 3A shows a cutaway view of the latching wheel of the present invention.

The protruded point 212 on the inner side of the numbered wheel 21 is embedded into the concave hole 222 of the latching wheel 22 on the inner surface of the latching wheel 22, such that the numbered wheel 21 drives the latching wheel 22 to rotate simultaneously through the contact surfaces. A spring 27 is disposed on each of the axle 26; an inner flange 223 is disposed on the central hole 221 of the latching wheel 22 (as shown in FIG. 3A) for pressing against an end of the spring 27, and the other end of the spring 27 presses against the inner surface of the lower casing 12.

Figure 3B:
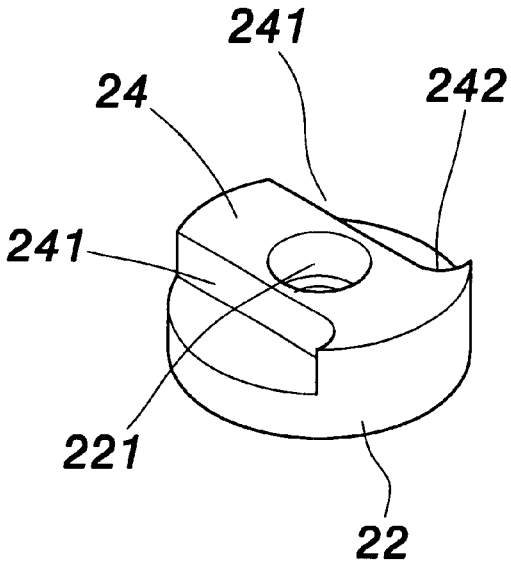
FIG. 3B is a rear-view diagram of the latching wheel of the present invention.

The fixing plate 30 is mounted onto the protruded latching portion 24 of latching wheel 22, and a guiding groove 31 is disposed at the fixing plate 30, and the guiding grooves 31 allows the embedment of each of the protruded latching portion 24. The latching protruded portion 24 is formed by removing two cutaway sections 241 from a circumference, and an end of the cutaway section 241 has a hooked flange 242 (as shown FIG. 3B). Each guiding groove 31 of the fixing plate 30 has a circular hole 32 corresponsive to the periphery of the latching wheel 22 such that the latching protruded portion 24 can be rotated in the circular hole 32. When the fixing plate rotates, it allows the bar-shape latching protruded portion 24 to slide towards the guiding groove 31, and the latching wheel 22 and the numbered wheel 21 can no longer rotate.

Figure 4:
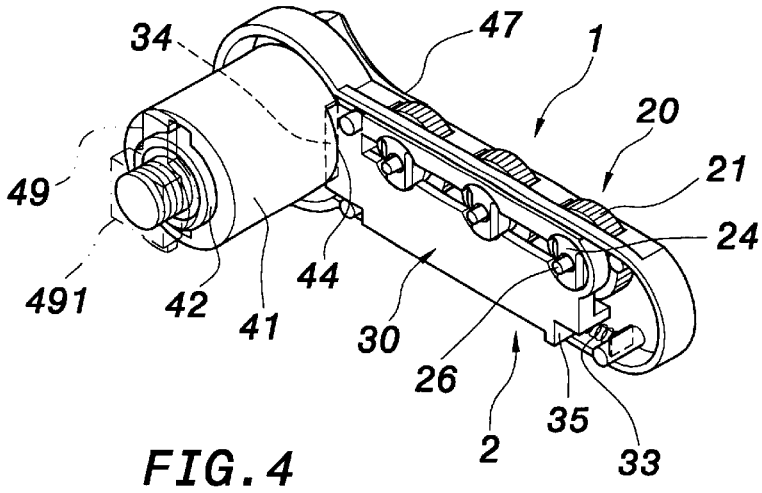
FIG. 4 is a rear view of the present invention when the bottom cover of the combination lock is not installed.
Figure 5:
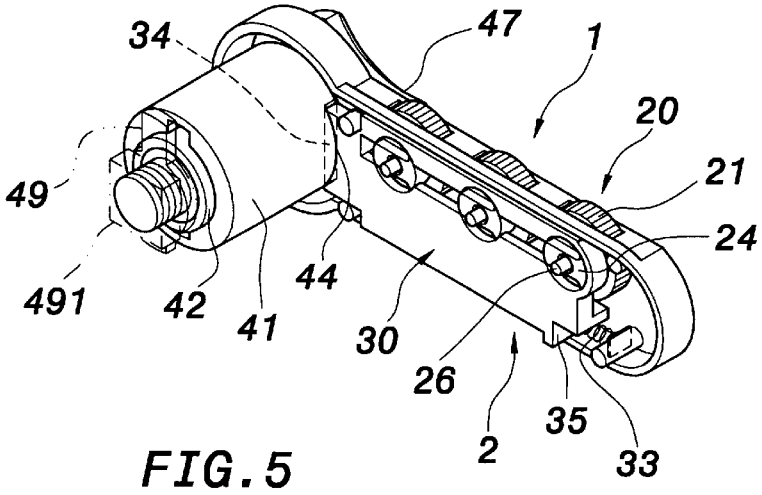
FIG. 5 is a diagram of the structure shown in FIG. 4 when the combination wheel is rotated and unlocked.
Figure 6:
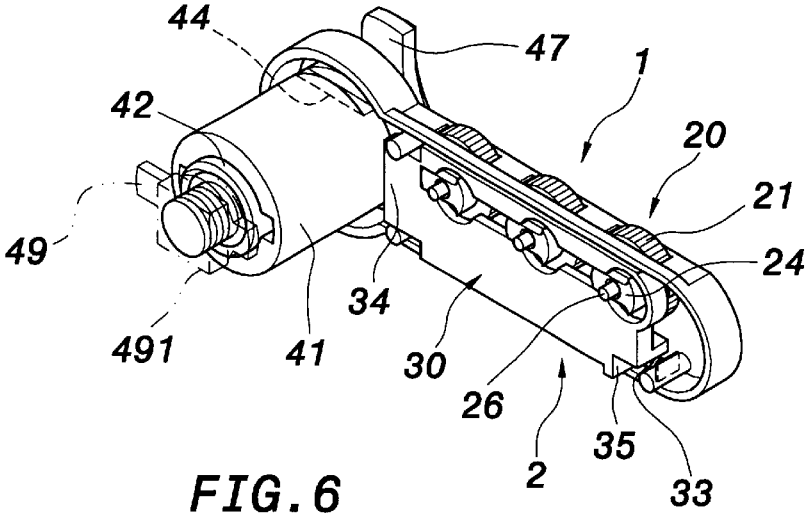
FIG. 6 is a diagram of the lock structure as shown in FIG. 4 when the lock is totally unlocked.

An end of the fixing plate 30 extends to the external cylinder 41 of the pivotal bases 15, 16, and the other end presses and couples to an elastic member 33 in the lock body 1, and the elastic member 33 is a spring pressing a pressing plate 35 of the fixing plate 30 such that it can keep the numbered wheel 20 in the state of rotation, and its movement is shown in FIG. 4 to FIG. 6. The internal cylinder directly drives the lock tongue 49 fixed by a small nut 491 to rotate.

The key lock mechanism comprises an external cylinder 41, an internal cylinder 42, and a lock core 43; the external cylinder is embedded between an upper pivotal base 15 and the lower pivotal base 16 in the lock body 1; the external cylinder 41 has a fixing groove 44, such that the combination lock mechanism 2 embeds a fixing lateral side 34 of the fixing plate 30 to the fixing groove 44 of the external cylinder 41; the internal cylinder 42 is sheathed into the external cylinder 41; the internal cylinder 42 includes a lock core 43; the external cylinder 41 has at least one latching groove 45. The ones shown in the figure is a pair of the latching grooves equidistantly disposed.

Figure 7:
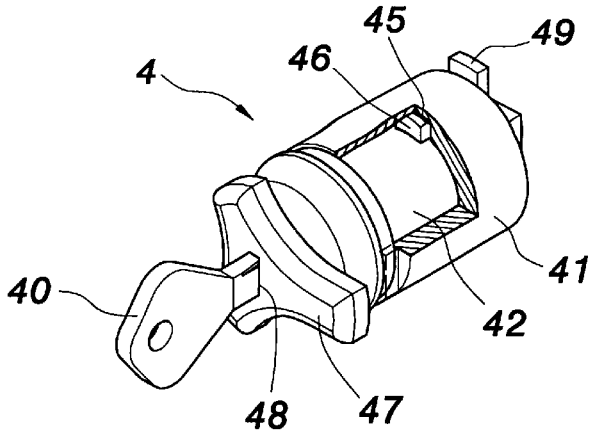
FIG. 7 is a diagram showing the front view of the key lock section of the present invention.
Figure 8:
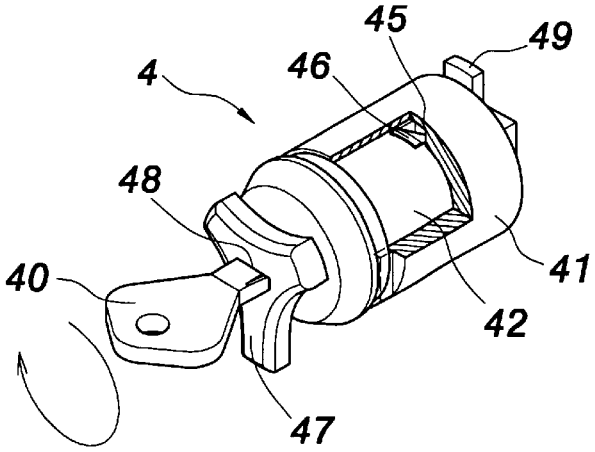
FIG. 8 is a diagram showing the structure as shown in FIG. 7 when the latch has just been released.
Figure 9:
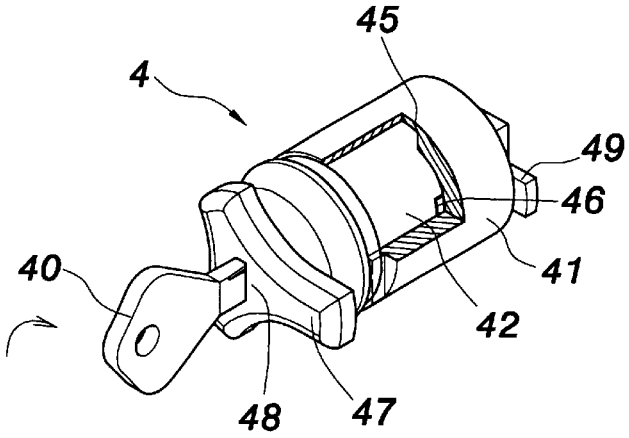
FIG. 9 is a diagram showing the structure as shown in FIG. 7 when the lock structure is completely unlocked.

The internal cylinder 42 has at least one protruded member 46, and the protruded member 46 is controlled by the lock core 43 for the contraction and extension movements. By inserting the protruded member 46 into the latching groove 45, the lock core 43 will securely lock the internal cylinder 41 and the external cylinder 42. The external cylinder 41 does not produce rotation, and the external end of the external cylinder 41 is coupled to a knob 47, and the knob 47 extends and exposes itself out of the upper pivotal base 15 of the upper casing 11, and a keyhole 48 is disposed in the end surface of the knob 47; the internal surface of the external cylinder 41 also protrudes out of the lower pivotal base 16 of the lower casing 12, and couples to a lock tongue 49; the lock tongue 49 rotates as the external cylinder 41 rotates. The key 40 produces the coupling and detachment movements to the external cylinder 41 through the lock core 43 of the internal cylinder 42 such that the lock tongue 49 will rotate according to the rotation of the external cylinder 41 for unlocking the lock or reversing the rotation for the locking. The movements are shown in FIG. 7 to FIG. 9.

A set of correct numbers can be used to adjust the numbered wheel of the combination lock in order to generate a sliding for the fixing plate 30, and the knob 47 can be rotated to release the latch between the fixing plate 30 and the external cylinder 41 such that the lock tongue 49 rotates as the external cylinder 41 rotates for the unlocking. The knob 47 can be rotated back to the original position, and the numbered wheel is rotated to prohibit the fixing plate to generate a sliding movement for the locking. Therefore the combination lock and the key lock can independently generate a coupling or a detachment movement to the lock tongue, and also lock the large nut 161 to an appropriate position on an article such as the a suitcase.

In view of the foregoing structure, the design of the fixing plate applied to the present invention can be used together with the design of the external cylinder to work with the plane combination lock and key locks of any kind. In other words, the fixing plate working together with the external cylinder can accomplish the locking and unlocking of the combination lock; the cooperation of the external cylinder, internal cylinder, and the lock core can complete the locking and unlocking of the key lock. Both locks can be implemented and operated independently. Furthermore, the lock tongue of the present invention can work together with the implementation of the internal cylinder of the key lock in different configurations. Similarly, the external appearance of the lock body can be of different shape, and the combination lock according to the present invention has the reconfiguration function. In FIG. 6, when the lock is totally unlocked, the spring on the numbered wheel has less pressure and allows the numbered wheel to freely rotate. The elasticity between the latching wheel and the numbered wheel is used to force them to rotate and change the number settings. Such arrangement can improve the security and gives a better usage to the lock structure, which is unlike the traditional lock mechanism.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dual mechanism lock, comprising:

a lock body, comprising an upper casing and a lower casing; an upper accommodating space being disposed in the upper casing, and the other end having an upper pivotal base; a lower accommodating space being disposed in the lower casing, and the other end having a lower pivotal base, such that the upper casing and the lower casing are coupled securely, and a plurality of upper groove holes are disposed on the internal surface of the upper casing; a plurality of lower groove holes are disposed on the internal surface of the lower casing;

a combination lock mechanism, comprising a plurality of combination wheels and a fixing plate, each combination wheel has a numbered wheel and a latching wheel, and a plurality of equidistant labeled numbers are disposed on the outer surface of the numbered wheel; the numbered wheel has a protruded point on its inner surface, and veins on its lateral side; the numbered wheel has a central hole; the latching wheel has a concave hole on its outer surface, and the latching wheel has a unidirectional fixed-point protruded portion on the internal surface of the latching wheel, and the latching wheel has a central hole; each numbered wheel couples an axle to the corresponding upper groove hole and lower groove hole in the lock body; the fixing plate has a guiding groove; the guiding groove allows the embedment of the guiding groove, and each of the axle is sheathed with a spring, and the other end of the flying plate presses and couples to an elastic member in the lock body; and a key lock mechanism, comprising the internal cylinder, an external cylinder, and a lock core, and the external cylinder is embedded between the upper pivotal base and the lower pivotal base; the external cylinder has a fixing groove, and the combination lock mechanism can embed the fixing groove of the external cylinder to the lateral side of the fixing plate, and the internal cylinder is sheathed into the external cylinder; the internal cylinder includes the lock core; a knob is coupled to the external end of the external cylinder, the knob is extended from the upper pivotal base, and a keyhole is disposed on the surface of the knob; the internal surface of the external cylinder extends from the lower pivotal base of the lower casing having a lock tongue such that the lock tongue rotates according to the external cylinder in order to produce a coupling and detachment movement of the lock core of the internal cylinder through the external cylinder by a key; and a set of correct numbers for the numbered wheel release the latch between the fixing plate and the external cylinder by rotating the knob for the unlocking.

2. A dual mechanism lock as claimed in claim 1, wherein said elastic member is a spring.

* * * * *